United States Patent [19]

Halvorson

[11] 4,429,846

[45] Feb. 7, 1984

[54] ADJUSTABLE TREE STAND

[76] Inventor: Harlan L. Halvorson, 701 - 6th St. SW., Wells, Minn. 56097

[21] Appl. No.: 275,900

[22] Filed: Jun. 22, 1981

[51] Int. Cl.[3] ..... F16M 13/00

[52] U.S. Cl. ..... 248/524; 248/527

[58] Field of Search ..... 248/524, 523, 525, 526, 248/527; 269/54.5

[56] References Cited

U.S. PATENT DOCUMENTS

| | | | |
|---|---|---|---|
| 1,091,000 | 3/1914 | Lyman | 248/524 X |
| 1,110,142 | 8/1914 | Piner | 248/524 X |
| 1,159,353 | 11/1915 | Bergwall | 248/527 |
| 1,457,820 | 6/1923 | Cleveland | 248/524 X |
| 1,481,015 | 1/1924 | Klein | 248/524 |
| 1,784,090 | 12/1930 | Dahl . | |
| 2,518,421 | 8/1950 | Freel . | |
| 2,703,213 | 3/1955 | Zamierowski . | |
| 2,875,968 | 3/1959 | Ekola . | |
| 2,904,291 | 9/1959 | Harbes et al. . | |
| 2,933,274 | 4/1960 | Mausolf | 248/524 X |
| 3,697,026 | 10/1972 | Hambrick | 248/524 |
| 4,190,983 | 3/1980 | Rostomily | 248/523 X |

*Primary Examiner*—Ramon S. Britts
*Assistant Examiner*—Sarah A. Lechok
*Attorney, Agent, or Firm*—Wicks & Nemer

[57] ABSTRACT

An adjustable tree stand including a support having a circular bottom with a wall at the periphery thereof. A series of legs are connected to the wall and a band for connection with a tree trunk. A circular plate is positioned on the circular bottom with the axis located centrally and substantially perpendicular to the plate coinciding with the central, vertical axis of the bottom. A spike is secured to the top of the plate offset from the axis of the plate. A pair of spaced flanges are formed on the plate for rotation of the plate on the support bottom to cant a tree having the spike inserted upwardly into the bottom end of the tree.

8 Claims, 4 Drawing Figures

ADJUSTABLE TREE STAND

SUMMARY

The invention relates to an improvement in stands for Christmas trees and more particularly to a stand for supporting the tree in a vertical position and having means for adjusting the vertical axis of the tree in the stand.

It has been found that in many instances the trunk of a Christmas tree is crooked, and it is difficult to maintain the tree in the stand with the trunk thereof in the best possible vertical attitude taking into account the irregularities in the trunk. It is, therefore, an object of the invention to provide a stand for a tree with which the trunk may be rotated a limited degree to compensate for an irregularity or crookedness in the trunk and/or the branches of the tree.

It will not be here attempted to set forth and indicate all of the various objects and advantages incident to the invention, but other objects and advantages will re referred to in or else will become apparent from that which follows.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
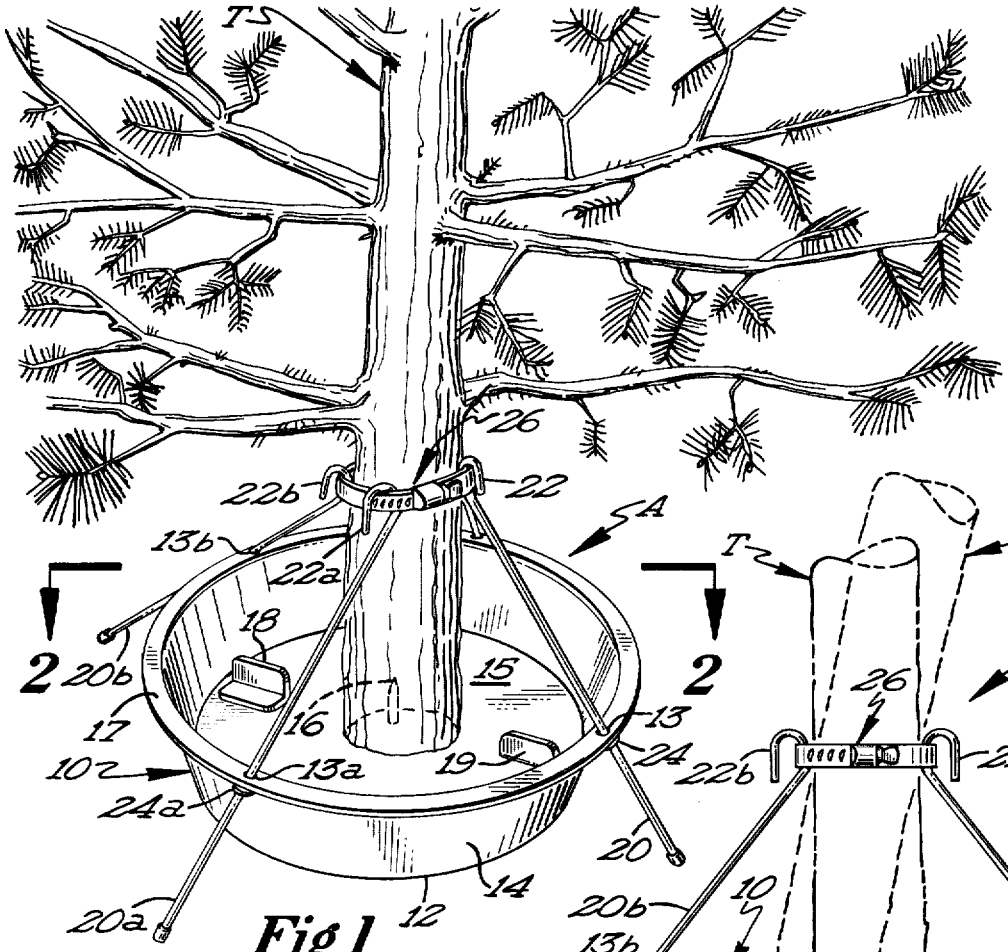
FIG. 1 is a perspective view of an adjustable tree stand embodying the invention with a tree mounted in the same.
Figure 3:
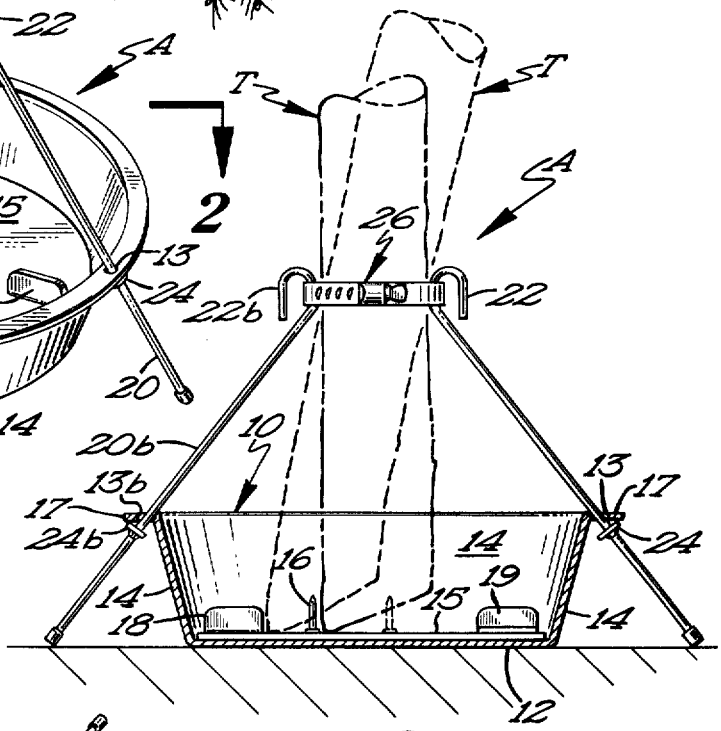
FIG. 3 is a vertical section through the stand pan with the legs and trunk band in operative tree trunk-holding position with a trunk shown in broken lines in adjustable positions.
Figure 2:
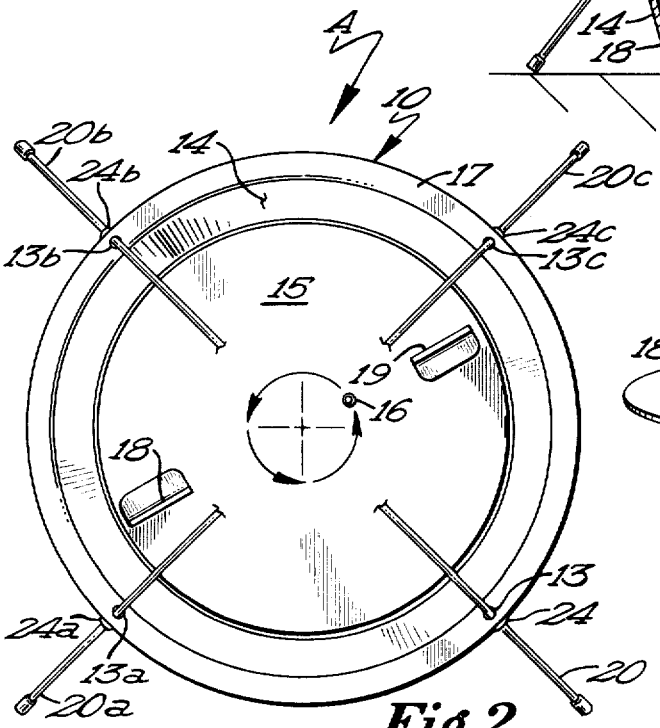
FIG. 2 is a top plan view on the line 2—2 of FIG. 1.
Figure 4:
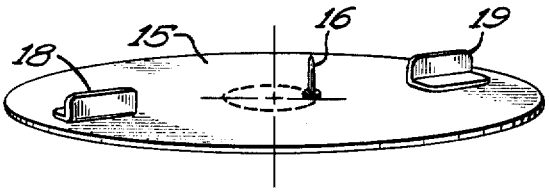
FIG. 4 is a perspective view of the circular support and adjusting plate.

Referring to the drawings in detail, the tree stand having apparatus for adjusting the vertical attitude A includes a support in one form of the pan 10 including the circular bottom 12. The circular bottom 12 has the peripheral upstanding wall 14. The wall 14 has formed on the upper edge thereof the rim 17 which has formed therethrough the four spaced holes 13, 13*a*, 13*b*, and 13*c*.

Further provided is the adjusting plate 15 which is flat and circular in formation. The diameter of the plate 15 is slightly less than the diameter of the pan bottom 12 on which the plate rests and on which it can be rotated as hereinafter referred to. The plate 15 has secured thereto by welding or other conventional securing means the upstanding pointed spike 16. The spike 16 is offset from the axial center of the circular plate.

The numeral 18 designates a first upstanding flange secured to the top of the circular adjusting plate adjacent the outer edge thereof by welding or other conventional means. The flange 18 may also be punched out of the plate and extended upwardly at a right angle to the plate. A second flange 19 is provided which is identical to flange 18 and positioned on a diameter of the plate opposite the first flange 18.

Additionally provided is a first leg 20 which has formed on the upper end thereof the open eye 22 and secured to and spaced from the lower end is a stop in the form of washer 24. Second, third and fourth legs 20*a*, 20*b* and 20*c* are provided, which are identical to first leg 20 with stops 24*a*, 24*b*, and 24*c* respectively.

The numeral 26 designates an adjustable band such as a conventional hose clamp which is positioned through the eyes, 22, 22*a*, 22*b* and 22*c* of the legs 20, 20*a*, 20*b* and 20*c* respectively for encirclement of a tree trunk as hereinafter described.

The stand A is assembled and used as follows: Each of the legs 20, 20*a*, 20*b* and 20*c* is extended through a hole 13, 13*a*, 13*b* and 13*c* respectively of the rim 17, up to the stop on each leg. A hole is drilled up into the bottom of the tree T slightly larger than the diameter of the spike 16. Then the band 26 is placed about the trunk of the tree with the band extending through the open eyes 22–22*c* and in engagement about the tree trunk and tightened slightly. The tree is then set upright with the spike 16 extended up into the hole drilled into the bottom of the tree T with the tree upon the plate 15, particularly FIGS. 1. and 3.

It has been found that a good number of trees, such as Christmas trees, have trunks that are not straight but have warped formations and may not have symmetrically positioned branches. With the present invention, the best positioning of the tree for eye appeal relative to the trunk and branch formation and the vertical may be made by rotating the plate 15 within the pan 10 by means of either of the flanges 18 or 19 which cants the tree one way or the other as the tree is caused to move in the eccentric circle relative to the bottom 12. Thus, a curve of a tree trunk or irregularity thereof in one direction may be brought towards the vertical providing a maximum of overall verticalness. The band 26 is initially left loose so that the tree may be rotated to a limited degree as the plate 15 is rotated. When the tree is adjustably position to that desired, the band 26 is then securely tightened.

Having thus described the invention, what is claimed as new and desired to be secured by Letters Patent is:

1. An adjustable tree stand comprising:

(a) a circular support having a central, vertical axis, (b) means for connecting a tree trunk to said support, (c) a circular adjusting plate having a central axis substantially perpendicular to the plate, (d) means mounting said circular plate on said support for rotation thereon with the axis of said circular support coinciding with the axis of said plate, (e) means for mounting the lower end of a tree on the plate offset from the axis of the plate, (f) means associated with said plate for rotating said plate on said support to cant a tree mounted thereon relative to the vertical axis of said support.

2. The device of claim 1 in which said circular support includes a sidewall on the peripheral edge thereof.

3. The device of claim 2 in which said means for connecting a tree trunk to said support includes (a) at least three legs, and (b) means for connecting each of said legs to a tree and said support.

4. The device of claim 1 in which said means for connecting a tree trunk to said support includes (a) at least three legs, and (b) means for connecting each of said legs to a tree and said support.

5. The device of claim 3 in which said means for mounting said circular plate on said circular support for rotation includes the diameter of said plate being slightly less than the diameter of said circular support.

6. The device of claim 2 in which said means for mounting the lower end of a tree on the plate offset from the axis of the plate includes a spike for insertion upwardly into the bottom of a tree secured to and upstanding upon the plate.

7. The device of claim 1 in which said means for mounting the lower end of a tree on the plate offset from the axis of the plate includes a spike for insertion upwardly into the bottom of a tree secured to and upstanding upon the plate.

8. The device of claim 1 in which said means associated with said plate for rotating said plate on said support includes an upstanding flange connected to said plate.

* * * * *